United States Patent [19]

Fedora et al.

[11] Patent Number: 4,599,818

[45] Date of Patent: Jul. 15, 1986

[54] MAGAZINE CATCH

[75] Inventors: Joseph Fedora, Palmer; Fred Zajechowski, Granby, both of Mass.

[73] Assignee: Bangor Punta Corporation, Greenwich, Conn.

[21] Appl. No.: 525,865

[22] Filed: Aug. 24, 1983

[51] Int. Cl.[4] ..... F41C 27/00

[52] U.S. Cl. ..... 42/7

[58] Field of Search ..... 42/7

[56] References Cited

U.S. PATENT DOCUMENTS

| | | | |
|---|---|---|---|
| 984,519 | 2/1911 | Browning | 42/7 |
| 4,236,337 | 12/1980 | Beretta | 42/7 |
| 4,449,311 | 5/1984 | Giragosian | 42/7 |

FOREIGN PATENT DOCUMENTS

| | | | |
|---|---|---|---|
| 55913 | 10/1912 | Austria | 42/7 |

*Primary Examiner*—Charles T. Jordan
*Attorney, Agent, or Firm*—Patrick J. Walsh

[57] ABSTRACT

Disclosed is a magazine catch for a pistol. The catch is reversible for operation from one or the other side of the pistol to release the magazine from the pistol. The catch includes a pin carrying a pair of projections. One of the projections engages a slot in the side of the magazine to retain the magazine in the pistol handle. The pin has a radially offset chamber which receives a locking screw. A spring in the chamber biases the screw and the pin axially away from one another. The screw carries a locking cam which projects through a slot in the pin for engagement in a locking grooves carried by the seat. By pressing the button on the end of the pin, the projection is displaced from the magazine slot to release the magazine. To operate the magazine catch from the opposite side of the pistol, the locking screw is rotated to withdraw the locking cam from the locking grooves. The catch is then axially removed from its seat, reversed in orientation, and inserted into the seat from the opposite of the pistol. The locking screw is then rotated to engage the locking cam in the locking grooves. Thus, the push button may be operated from either side of the pistol.

10 Claims, 5 Drawing Figures

MAGAZINE CATCH

BACKGROUND OF THE INVENTION

The present invention relates to a magazine catch for a pistol and particularly relates to a right or left operated magazine catch for a pistol so that the magazine can be removed without the individual using the pistol removing the pistol from the shooting hand.

In most pistols, the magazine is blocked and unblocked relative to a cavity within the handle of the pistol by a magazine catch. Such catches are conventionally slidable transversely of the pistol handle to engage and retain the magazine within the cavity. Thus, to release the magazine from the handle, the catch is shifted transversely to disengage from the magazine slot enabling the magazine to be ejected or withdrawn from the cavity of the handle. Most such catches operate unidirectionally. That is, the catch is operated from one side of the pistol to release the magazine. It cannot be operated to release the magazine from the other side of the pistol. This arrangement is satisfactory, for example, for a right handed shooter where the push button for operating the catch is located on the left side of the pistol. Thus, the magazine may be replaced without removing the pistol from the individuals' shooting hand. However, for a left handed shooter using the same pistol, the push button of the left side of the pistol is not conveniently located for operation of the catch by the left shooting hand. The converse is also true. That is, a right handed shooter cannot conveniently utilize a pistol with the push button operated from the right side of the pistol. While pistols may be manufactured with discrete catches on the right or left side of the pistol for operation by left and right handed shooters, respectively, convenient use of the pistol is thus limited dependent on whether the shooter is right or left handed.

In U.S. Pat. No. 4,236,337, there is disclosed a sliding magazine catch for a pistol wherein the catch for latching the magazine in the pistol handle is reversible. That is, the catch can be assembled in the pistol for a right handed shooter, with the catch push button located on the left side of the pistol, or for a left handed shooter, with the catch push button located on the right side of the pistol. Thus, the pistol disclosed in that patent can be utilized by either a right of left handed shooter by assembling the catch for operation from the appropriate side of the pistol dependent on whether the shooter is right or left handed. However, the catch mechanism disclosed in that patent requires substantial manipulation of the catch for both assembly and disassembly thereof relative to the frame of the pistol. Moreover, such catch is somewhat mechanically complex and appears relatively expensive to manufacture. Thus, there has arisen a need for a catch for blocking and unblocking a magazine relative to a pistol which can be readily and easily assembled and disassembled for operation from one or the other sides of the pistol and without substantial manipulation thereof.

SUMMARY OF THE PRESENT INVENTION

Accordingly, it is a primary object of the present invention to provide a novel and improved right or left operated magazine catch for a pistol so that a left or right handed shooter can replace the magazine without removing the pistol from the shooting hand.

It is another object of the present invention to provide a novel and improved right or left operated magazine catch for a pistol wherein the magazine catch can be readily and easily field assembled and disassembled for either left or right hand operation.

It is still another object of the present invention to provide a novel and improved right or left operated magazine catch for a pistol having the foregoing characteristics wherein the magazine catch can be field assembled and disassembled with the aid only of a readily available screwdriver, pocket knife or similar type instrument.

It is a further object of the present invention to provide a novel and improved right or left operated magazine catch for a pistol having the foregoing characteristics wherein the magazine catch can be assembled and disassembled without substantial manipulation of the catch relative to the pistol and essentially requiring insertion or removal of the catch relative to its seat in the pistol handle by only a single transverse axial motion and a rotational locking or unlocking motion.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing and other objects and advantages and in accordance with the purposes of the present invention, as embodied and broadly described herein, a magazine catch for a pistol having a handle for receiving the magazine, a cavity in the handle for receiving the magazine, a seat in the handle for receiving the catch, and a locking groove on each of the opposite sides of the seat, the magazine having retaining slots along opposite sides thereof, catch comprises a generally cylindrical elongated catch body having a projection at one end thereof for engagement with the magazine in one of its slots to retain the magazine in the handle of the pistol, a member carried by the body for axial slidable movement relative thereto and having a locking arm projecting generally laterally therefrom for engagement in one or the other of the locking grooves carried by the seat of the handle to retain the catch in the handle, spring means cooperable between the body and the member for biasing the body and the member for axial movement in a direction away from one another to locate the projecton engagement with one of the magazine slots, the body being axially movable relative to the member against the bias of the spring means to displace the projection from the one magazine slot and thereby release the magazine from the handle, and means for displacing the arm from the locking groove to enable removal of the catch from the seat.

Preferably, the body and the member are ganerally cylindrical. The member is disposed for rotation about an axis generally parallel to, but radially offset from the axis of the cylindrical body. In this manner, the member is rotatable about its axis and relative to the body such that in a first rotational position of the member the locking arm extends beyond the lateral extremities of the body for engagement in the one locking groove of the handle and in a second rotational position the locking arm lies wholly within the lateral extremities of the body to enable removal of the catch from the seat. Thus, a simple quarter turn of the member relative to the body and axial movement of the catch relative to the handle is all that is necessary to reverse the position of the catch for operation from either side of the pistol.

The accompanying drawings which are incorporated in and constitute a part of this specification, illustrate one embodiment of the invention and, together with the description, serve to explain the principles of the invention.

DESCRIPTION OF A PREFERRED EMBODIMENT

Reference will now be made in detail to the preferred embodiment of the present invention, an example of which is illustrated in the accompanying drawings.

Figure 1:
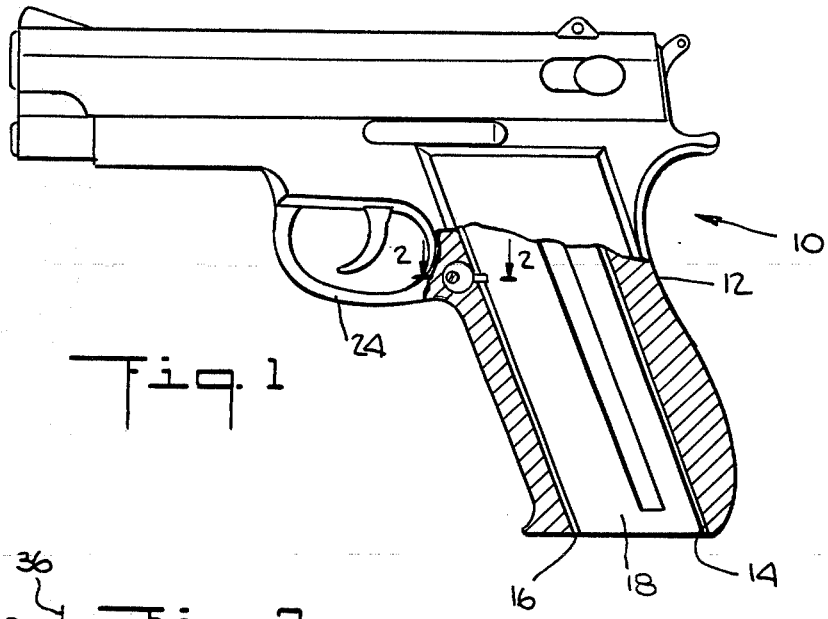
FIG. 1 is a side elevational view of a pistol with parts broken out and in cross section illustrating a magazine catch constructed in accordance with the present invention.
Figure 2:
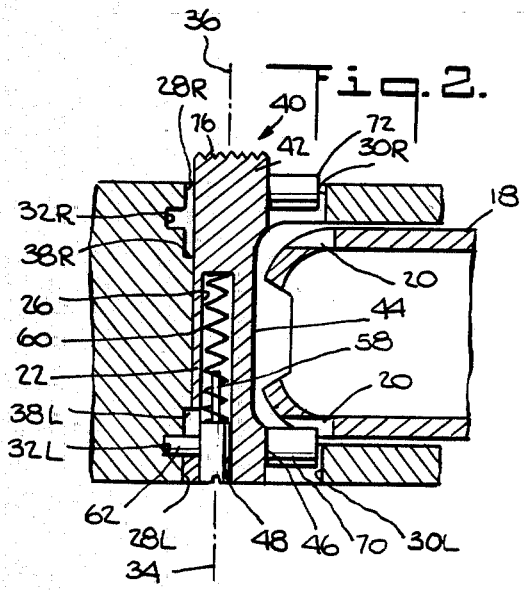
FIG. 2 is an enlarged fragmentary cross sectional view of the magazine catch hereof disposed in a seat in the handle of the pistol for operation from the right side of the pistol and thus useful for a left handed shooter.
Figure 3:
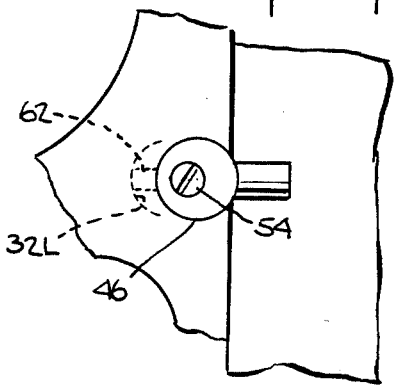
FIG. 3 is a fragmentary elevational view thereof looking from left to right in FIG. 2.
Figure 4:
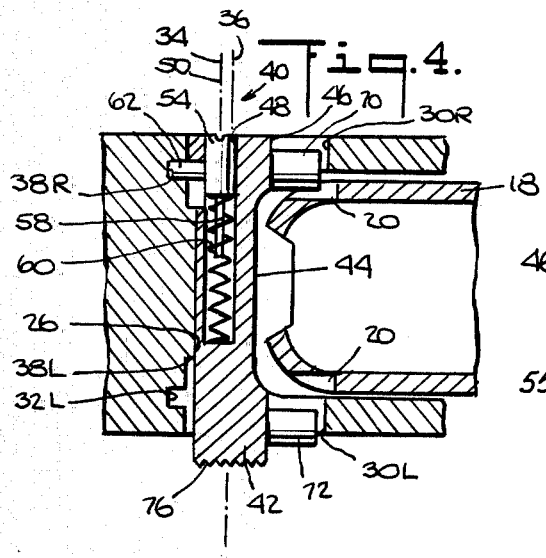
FIG. 4 is a view similar to FIG. 2 with the magazine catch disposed in the reverse position, e.g., for operation from the left side of the pistol and thus useful for a right handed shooter.
Figure 5:
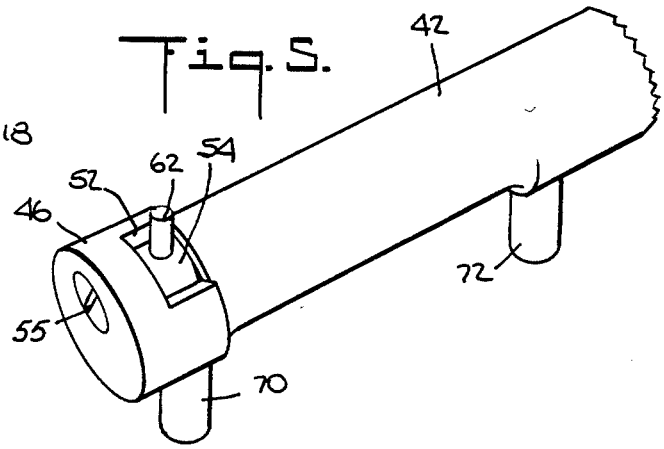
FIG. 5 is a perspective view of the magazine catch hereof.

Referring now to FIG. 1, there is illustrated a pistol, generally designated 10, having a handle 12 defining a cavity 14 with an end opening 16 for receiving a magazine 18. As best illustrated in FIGS 2 and 4, magazine 18 has a pair of slots or openings 20 along opposite sides thereof for receiving in one or the other of the slots of the magazine catch hereof in accordance with whether the magazine catch is configured for right of left operation as will become clear from the ensuing description. Pistol 10 is conventional in construction except as otherwise noted. Adjacent the upper end of cavity 14 is a transverse seat 22 between cavity 14 and a trigger guard 24. Seat 22 opens into cavity 14. Seat 22 is symmetrical in shape on opposite sides of the pistol and includes a generally cylindrical central section 26 and an enlarged cylindrical bore 28L and 28R at opposite ends thereof, respectively. Adjacent seat 22 and opening into magazine cavity 14 on opposite sides of the pistol handle are frame catch slots 30L and 30R, respectively, the latter slots lying in traverse registry with the respective magazine slots 20 when the magazine is blocked in the pistol handle.

For reasons discussed hereinafter, locking grooves 32L and 32R are disposed along one side of the enlarged bores 28L and 28R, respectively. Grooves 32L and 32R are semicylindrical in shape and are formed about an axis 34 offset from axis 36 of the generally cylindrical section 22, the grooves 32L and 32R lying on the side of the handle opposite magazine catch slots 30L and 30R, respectively. Grooves 32L and 32R are also formed intermediate the outer faces of the handle and the shoulders 38L and 38R formed between enlarged bores 28L and 28R, respectively, and the central cylindrical section 26.

In accordance with the present invention, there is provided a magazine catch, generally designated 40, for reception in seat 22 from either sides of the pistol. Particularly, catch 40 includes an elongated generally cylindrical pin 42 shaped generally to conform to the cylindrical shaped seat 22. More particularly, pin 42 has a central generally cylindrical section 44 and a diametrically enlarged generally cylindrical end section 46 for reception in either of enlarged bores 28L or 28R as described hereinafter. A generally cylindrical chamber 48 is formed through the same end of pin 42 having the diametrically enlarged section 46. Chamber 48, however, is formed about an axis 50 radially offset from the axis of pin 42. Preferably, and in final assembly of the catch in the handle, axis 50 is coincident with the axis 34 about which the locking groove is formed. Pin 42 is also oprovided with a radial slot 52 opening into chamber 48. Slot 52 extends circumferentially about pin 42 a distance of about ninety degrees, e.g., about a quarter turn, and has an axial extent at least equal to the extent of travel of pin 42 when pin 42 is axially translated to unblock the magazine as described hereinafter.

Disposed within chamber 48 is a cam locking screw 54 having a slot 55 formed in its outer end face for receipt of a screwdriver, pocket knife or similar type instrument. Locking screw 54 has a reduced diameter stem 58 projecting axially from its inner end. A coil spring 60 is disposed within chamber 48 partially about stem 58 for biasing locking screw 54 for axial outward displacement away from pin 42. Locking screw 54 carries a locking arm or cam 62 which projects radially through slots 52 in pin 42. Cam 62 projects radially beyond the outer surface of the diametrically enlarged end section 46 of pin 42. Thus, spring 60 baises locking screw 54 axially away from pin 42 with the end of slot 52 serving as a stop for cam 62 to limit the axial outward movement of screw 54 relative to pin 42.

Catch 40 also includes radially extending projections 70 and 72 at opposite ends of pin 42. Projection 70 serves to engage in the frame slot 30L or 30R and a magazine slot 20 and thus retain the magazine within the handle of the pistol. Projection 72 serves to occupy the frame slot 30L or 30R on the opposite side of the handle. The end of pin 42 opposite the end thereof carrying locking screw 54 is knurled as at 76. Thus, knurled pin end 76 serves as a push button for operating the magazine catch hereof.

In use, with the magazine removed from the handle, catch 40 may be inserted into seat 22 from either side of the pistol depending on whether operation from the left or right side of the pistol is desired. For example, for a left handed shooter, operation from the right side of the pistol is desirable as illustrated in FIG. 2. Thus, catch 40 is inserted into seat 22 from the left side of the pistol such that the knurled pin end 76 lies on the right side of the pistol. Particularly, cam locking screw 54 is rotated by means of a screwdriver, pocket knife or the like to locate the tip of the locking cam 62 flush with the outer surface of the diametrically enlarged section 46. Projection 72 is then alined with the frame catch slots 30L and 30R and pin 42 is inserted into the seat from the left side of the pistol with the knurled pin end being introduced first. Because cam 62 lies flush with the outer surface of enlarged section 46. section 46 may be received axially and fully into the enlarged bore 28L. When the shoulder of pin 42 engages the shoulder of the seat, locking screw 54 is rotated, again by means of a screwdriver, pocket knife or the like, about a quarter turn to engage locking cam 62 in the locking cam groove 32L. Accordingly, the magazine catch is secured within seat 22 against removal therefrom in an axial direction. When secured within the seat as just described, projection 70 will be in position to engage in the magazine slot 20 on the corresponding side of the magazine to retain the magazine in the handle once the magazine is inserted into the cavity 14.

To release the magazine, the knurled end 76 of pin 42 on the side of the pistol opposite locking screw 54 is pressed axially inwardly against the bias of spring 60. This axial displacement of pin 42 causes projection 70 to disengage from the magazine slot 20 enabling removal of the magazine from the handle.

For a right handed shooter, the catch is operated from the left side of the pistol. To reverse the catch from the position thereof illustrated in FIG. 2 to the position illustrated in FIG. 4 to accommodate operation of the catch from the left side of the pistol, locking screw 54 is rotated about a quarter turn. This disengages locking cam 62 from the locking groove 32L. With the magazine removed from the handle, the magazine catch can be withdrawn axially from the left side of the pistol. Once withdrawn, the catch hereof is reversed in position and inserted axially, with the knurled end first, into the seat from the right hand side of the pistol. When the shoulder on section 46 engages the shoulder of the enlarged bore, locking screw 54 is rotated about a quarter turn to engage the locking cam 62 in the locking groove 32R. This locates projection 70 in position to engage in the magazine slot 20 upon insertion of the magazine into the handle cavity. Thus, operation of the magazine catch is provided from the left side of the pistol simply by pressing the knurled pin end 76 against the bias of spring 60 similarly as previously described with respect to operation of the magazine catch from the right side of the pistol.

From the foregoing description, it will be appreciated that there has been provided a magazine catch which can be readily and easily assembled and disassembled in the field to enable operation of the catch from either side of the pistol. This reversal of operation of the catch is accomplished without significant manipulation of the catch or pistol and is accomplished by simple axial movement of the catch toward or away from its seat in the handle and rotation of the locking screw about a quarter turn. Moreover, the foregoing described magazine catch is readily and easily manufactured and retrofitted to existing pistols.

It will be apparent to those skilled in the art that various modifications could be made in the magazine catch hereof without departing from the scope or spirit of the invention.

What is claimed is:

1. A magazine catch for a pistol having a handle for receiving a magazine, a seat in the handle for receiving the catch, and a locking groove on each of the opposite sides of the seat, the magazine having magazine retaining slots along opposite sides thereof, comprising:

a generally elongated catch body having a projection at one end thereof for engagement with the magazine in one of its slots to retain the magazine in the handle of the pistol, a member carried by said body for axial slidable movement relative thereto and having a locking arm projecting generally laterally therefrom for engagement in one or the other of the locking grooves carried by the seat of the handle to retain the catch in the handle, said member being rotatable relative to said body and said locking arm being displaceable from the locking groove upon rotation of said member relative to said body, spring means cooperable between said body and said member for biasing said body and said member for axial movement in a direction away from one another to locate the projection in engagement with one of the magazine slots, said body being axially movable relative to said member against the bias of said spring means to displace the projection from the one magazine slot and thereby release the magazine from the handle, and means for displacing the arm from the locking groove to enable removal of the catch from the seat.

2. A magazine catch according to claim 1 wherein the member is rotatable about an axis relative to said body such that in a first rotational position of said member the locking arm extends beyond the lateral extremities of said body for engagement in the one locking groove of the handle, and in a second rotational postition of said member the locking arm lies wholly within the lateral extremities of said body to enable removal of the catch from the seat.

3. A magazine catch according to claim 2 wherein the body is generally cylindrical, said member being rotatable about an axis generally parallel to, and radially offset from, the said of said generally cylindrical body.

4. A magazine catch according to claim 1 wherein said member is rotatable about an axis relative to said body such that in a first rotational position of said member the locking arm extends beyond the lateral extremities of said body for engagement in the one locking groove of the handle and in a second rotational position of said member the locking arm lies wholly within the lateral extremities of said body to enable removal of the catch from the seat, said body having a generally cylindrical opening through one end thereof and a slot opening laterally thereof into said chamber, said member being generally cylindrical and disposed in said chamber with the locking arm projecting radially therefrom through said body slot for engagement in one or the other of said locking grooves, said spring means including a spring disposed in said chamber.

5. A magazine catch according to claim 4 wherein said body has a projection at its opposite end, and a button carried by said body for manually displacing said body against the bias of said spring to displace the first mentioned projection from the one magazine slot, said body and said member being removable from the seat for reversible disposition therein thereby enabling location of said button on either the right or the left side of the pistol.

6. A pistol comprising:

a pistol frame having a handle defining a cavity for receiving a magazine, means carried by said frame defining a generally cylindrical seat adjacent to and opening into said cavity, means carried by said frame defining a locking groove adjacent each of the opposite sides of said seat, a catch including a generally elongated catch body having a projection at one end thereof for engagement with the magazine to retain the magazine in said cavity, a member carried by said body for axial slidable movement relative thereto and having a locking arm projecting generally laterally therefrom for engagement in one or the other of said locking grooves to retain said catch in said handle, said member being rotatable relative to said body and said locking arm being displaceable from one or the other of the locking grooves upon rotation of said member relative to said body, a spring cooperable between said body and said member for biasing said body and said member for axial movement in a direction away from one another to locate the projection in engagement with the magazine, said body being axially movable relative to said member against the bias of said spring to displace the projection from engagement with the magazine and thereby release the magazine from said cavity, means for displacing said arm from said locking groove to enable removal of said catch from said seat.

7. A pistol according to claim 6 wherein said member is rotatable about an axis relative to said body such that in a first rotational position of said member the locking arm extends beyond the lateral extremities of said body for engagement in one or the other of said locking grooves, and in a second rotationable position of said member the locking arm lies wholly within the lateral extremities of said body to enable removal of the catch from the seat.

8. A pistol according to claim 7 wherein the body is generally cylindrical, said member being rotatable about an axis generally parallel to, and radially offset from, the axis of said generally cylindrical body.

9. A pistol according to claim 6 wherein said member is rotatable about an axis relative to said body such that in a first rotational position of said member the locking arm extends beyond the lateral extremities of said body for engagement in one or the other of said locking grooves, and in a second rotational position of said member the locking arm lies wholly within the lateral extremities of said body to enable removal of the catch from the seat, said body having a generally cylindrical opening through one end thereof and a slot opening laterally thereof into said chamber, said member being generally cylindrical and disposed in said chamber with the locking arm projecting radially therefrom through said body slot for engagement in one or the other of said locking grooves, said spring means including a spring disposed in said chamber.

10. A pistol according to claim 9 wherein said body has a projection at its opposite end, and a button carried by said body for manually displacing said body against the bias of said spring to displace the first mentioned projection from the one magazine slot, said body and said member being removable from the seat for reversible disposition therein thereby enabling location of said button on either the right or left side of the pistol.

* * * * *